US007325720B2

(12) United States Patent
Jeppsson et al.

(10) Patent No.: US 7,325,720 B2
(45) Date of Patent: Feb. 5, 2008

(54) PACKAGE

(75) Inventors: Ulf Jeppsson, Ystad (SE); Niilo Poyhonen, Lappeenranta (FI)

(73) Assignee: Forpacknings/AB Nord-Emballage (SE)

( * ) Notice: Subject to any disclaimer, the term of this patent is extended or adjusted under 35 U.S.C. 154(b) by 0 days.

(21) Appl. No.: 10/398,680

(22) PCT Filed: Oct. 9, 2001

(86) PCT No.: PCT/SE01/02190

§ 371 (c)(1),
(2), (4) Date: Sep. 5, 2003

(87) PCT Pub. No.: WO02/30762

PCT Pub. Date: Apr. 18, 2002

(65) Prior Publication Data

US 2004/0026490 A1 Feb. 12, 2004

(30) Foreign Application Priority Data

Oct. 9, 2000 (SE) ..... 0036442

(51) Int. Cl.
*B65D 5/02* (2006.01)
*B65D 43/14* (2006.01)

(52) U.S. Cl. ..... 229/208; 229/137; 229/223

(58) Field of Classification Search ..... 229/137, 229/208, 160.2, 221, 222, 223
See application file for complete search history.

(56) References Cited

U.S. PATENT DOCUMENTS

| | | | | | |
|---|---|---|---|---|---|
| 1,242,534 | A | * | 10/1917 | Eaton | 229/160.2 |
| 2,178,730 | A | * | 11/1939 | Stein | 229/223 |
| 2,345,486 | A | * | 3/1944 | Leebov | 229/222 |
| 2,695,745 | A | | 11/1954 | Dixon | |
| 3,118,586 | A | * | 1/1964 | Kelly | 229/137 |
| 3,229,890 | A | * | 1/1966 | Wright | 229/137 |
| 3,392,901 | A | * | 7/1968 | Krzyzanowski | 229/223 |
| 3,439,866 | A | | 4/1969 | Kohnle | |
| 4,053,103 | A | * | 10/1977 | Gaudish | 229/137 |
| 4,228,898 | A | | 10/1980 | Zeitter et al. | |
| 4,732,275 | A | | 3/1988 | Hambleton et al. | |
| 5,348,400 | A | | 9/1994 | Haiss et al. | |
| 5,437,406 | A | | 8/1995 | Gordon et al. | |
| 6,047,883 | A | | 4/2000 | Calvert et al. | |
| 6,182,889 | B1 | * | 2/2001 | Heeley et al. | 229/221 |

* cited by examiner

*Primary Examiner*—Gary E. Elkins
(74) *Attorney, Agent, or Firm*—James Ray & Associates

(57) ABSTRACT

A package formed from a cardboard blank having crease lines and wall panels, bottom flaps forming a bottom of the package and top flaps, namely short-side flaps and long-side flaps, folded and heat sealed together to form the top of the package. One of the long-side flaps has at its free end a seal tab, which is provided with a heat seal adhesive and is sealed against the opposite long-side flap. The seal tab has a smaller length than the width of the package for enabling it to be brought down into the top of the package for re-closing thereof.

3 Claims, 2 Drawing Sheets

PACKAGE

TECHNICAL FIELD

The present invention relates to a package, which is made of a cardboard blank with crease lines and has wall panels, bottom flaps forming a bottom of the package, and top flaps, namely two long-side flaps extending unbroken over the width of the package and two short-side flaps, said top flaps being folded and heat sealed together to form a top of the package, which may be of the gable top type or the parallelepipedical type.

BACKGROUND OF THE INVENTION

Dry foodstuffs, like cereals, meal, and gruel, are most often packed in cardboard boxes or packages of the gable top type or the parallelepipedical type. For different reasons, it is customary to make the cardboard of waste fibres and to pack the foodstuff in an inner bag of for example plastic, which preserves the foodstuff in a good condition, until the bag is opened, and prevents the foodstuff from getting in contact with the waste fibre cardboard.

Coated cardboard materials of virgin fibres are now at hand, which are lighter than conventional materials, per se are completely tight for dry materials, and do not give any taste or smell to the packed product. In this way the dry foodstuff can be packed directly in the package without any inner bag, provided that the package can be sealed in a tight manner.

THE INVENTION

A problem with a tightly sealed package is that it may be difficult to open and—after use—reclose.

This problem may according to the invention be solved in that one of the long-side flaps at its free end is provided with a seal tab, which is provided with heat seal adhesive for sealing against the opposite long-side flap or the opposite wall panel and which has a smaller length than the width of the package for enabling it to be brought down into the top of the package for reclosing thereof.

In order to give easy access to this seal tab it may according to the invention be provided with a lift tab at its free end.

The design according to the invention makes it possible to use the seal tab inserted between one of the long-side flaps and the short-side flaps as a closure means. Hereby moisture and noxious animals can be kept out also after initial opening of the package.

THE DRAWINGS

Figure 2:
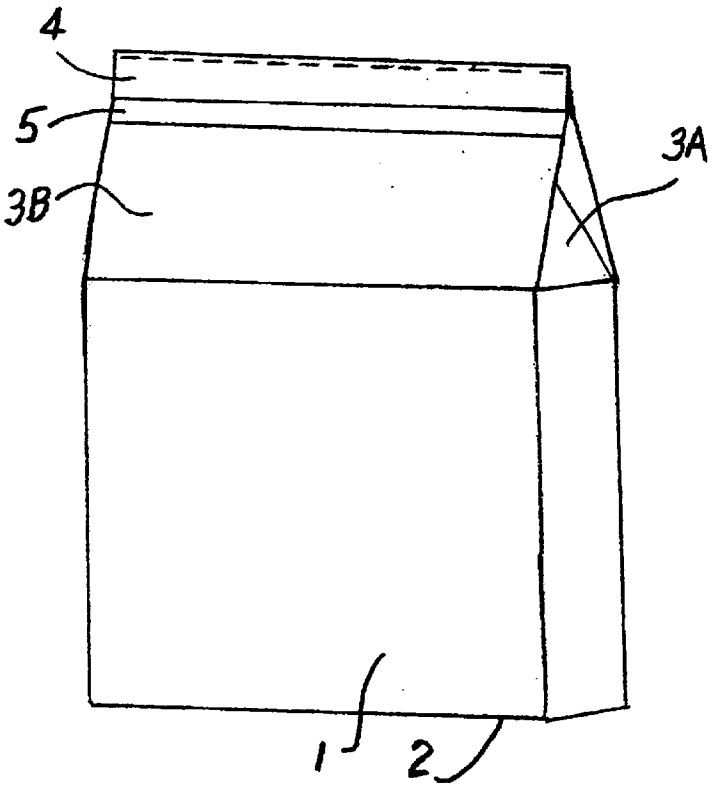
Figure 1:
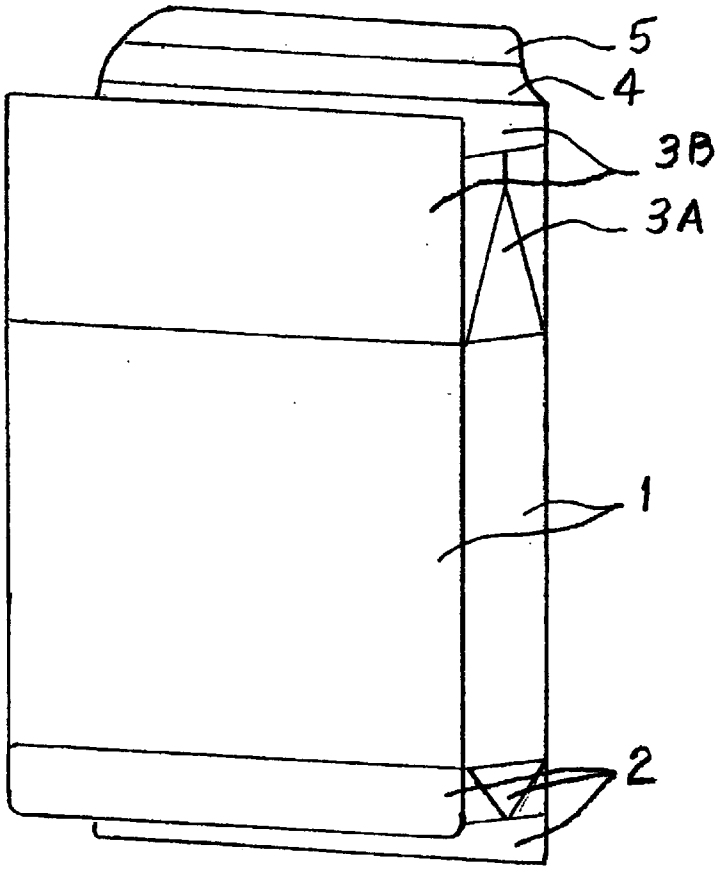
Figure 4:
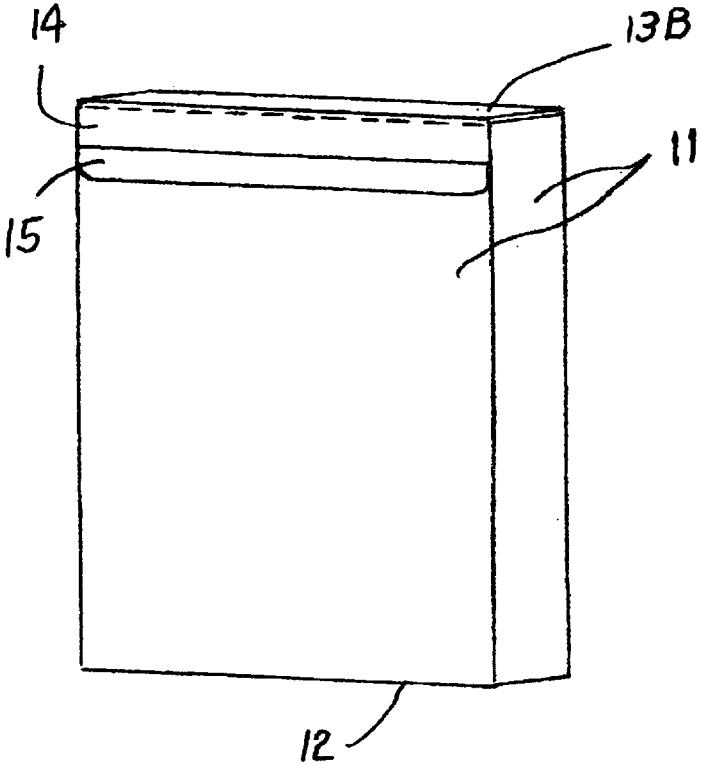
Figure 3:
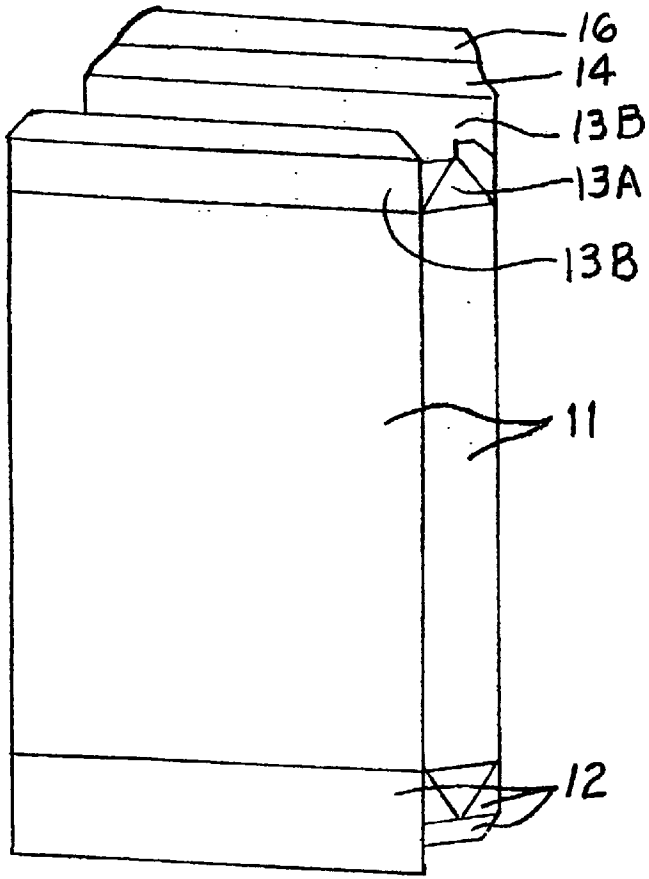

The invention will be described in further detail below reference being made to the accompanying drawings, in which FIGS. 1 and 2 are perspective views of a first embodiment of a package according to the invention in a semi-finished form and a finished form, respectively, and FIGS. 3 and 4 are similar views of a second embodiment.

DETAILED DESCRIPTION OF PREFERRED EMBODIMENTS

A package according to the invention is typically made of coated cardboard, preferably manufactured of virgin fibres, which is a prerequisite for allowing foodstuffs to be contained in the package without any inner bag or the like. The cardboard material may contain different layers, for example a barrier layer of EVOH. The coating may for example be polyethylene. The cardboard material is preferably completely tight for dry materials.

A cardboard blank is first cut and creased and is sealed along a side edge in a conventional way to form a semi-finished package, open in both ends, as shown in FIG. 1. It appears that this package has wall panels 1, bottom flaps 2, and top flaps 3 (flaps 3A and 3B to be described).

The bottom flaps 2 are then conventionally folded and for example heat-sealed to form a tight bottom, as is illustrated in the lower part of FIG. 2.

The package is now ready for filling, preferably with a dry foodstuff, such as cereals, meal, or gruel.

Hereafter the top of the package is to be sealed. In a conventional way the two short-side flaps 3A are folded in along their crease lines, and the two long-side flaps 3B are brought in contact with each other and are heat sealed to form a tight top.

One of the long-side flaps 3B—the rear one in FIG. 1—has integrally therewith but preferably separated by crease lines a seal tab 4 and a lift tab 5. Hot melt adhesive is applied to the seal tab 4, whereupon the two tabs 4 and 5 are folded down over the formed top of the package and the seal tab 4 is sealed by heat to the opposite long-side flap 3B, so that a so called gable top package as shown in FIG. 2 is formed.

For initially opening the package, the seal tab 4 may be lifted by the lift tab 5, so that the seal provided by the hot melt adhesive is broken and the long-side flaps 3B may be pulled apart to the extent necessary for allowing pouring out of the contents of the package.

An important aspect of the design is that the package may be reclosed after each opening by pushing down the tabs 4 and 5 between the opposite long-side flap 3B and the folded short-side flaps 3A.

FIGS. 3 and 4 show a parallelepipedical package instead of the gable top package of FIGS. 1 and 2. Also this package has wall panels 11, bottom flaps 12 and top flaps 13. From the stage shown in FIG. 3, the bottom flaps 12 are conventionally folded and for example heat-sealed to form a tight bottom, as is illustrated in the lower part of FIG. 4.

After filling, the top of the package is to be sealed. In a conventional way the two short-side flaps 13A are folded in along their crease lines, and the upper portions of the long-side flaps 13B (which here are separated from the remainder of the flaps by crease lines) are brought in contact with each other and are heat sealed to form a tight top.

The seal tab 14 formed on the rear long-side flap 13B is provided with hot melt adhesive. The top is folded down, and the seal tab 14 is sealed by heat to the upper portion of the front wall panel 11, so that a parallelepipedical package as shown in FIG. 4 is formed.

This package can be opened by lifting the lift tab 15 and then reclosed after opening as described above with reference to FIGS. 1 and 2.

What is claimed is:

1. A package formed from a cardboard blank having crease lines and wall panels, said package comprising:

(a) a plurality of bottom flaps forming a bottom of said package;

(b) a plurality of top flaps comprising first and second long-side flaps extending unbroken over the width of the package and first and second short-side flaps, said first and second long-side flaps extending longitudinally above the height of first and second short-side flaps, said top flaps capable of being folded and heat sealed together to form a top of said package, (c) a seal tab having a first and second end, said first end of said seal tab extending from an end of said first long-side flap, said seal tab being provided at an inside surface with heat seal adhesive for initial sealing against one of said second long-side flap and an opposite wall panel of said package, (d) a lift tab extending from said second end of said seal tab, said seal tab and said lift tab having a smaller length than the width of said package enabling said seal tab and said lift tab to be tucked down between said first and second long-side flaps and said folded short-side flaps and into said top of said package for re-closing thereof.

2. A package as recited in claim 1 wherein said top flaps are capable of being folded and heat sealed together to form a gable top package.

3. A package as recited in claim 1 wherein said top flaps are capable of being folded and heat sealed together to form a parallelepiped package.

* * * * *